US008974041B2

(12) United States Patent
Boot et al.

(10) Patent No.: US 8,974,041 B2
(45) Date of Patent: Mar. 10, 2015

(54) DROPLET SELECTION MECHANISM

(75) Inventors: Ronaldus Jacobus Johannes Boot, Son en Breugel (NL); René Jos Houben, Nederweert (NL); Gerrit Oosterhuis, Best (NL); Antonius Paulus Aulbers, Eindhoven (NL)

(73) Assignee: Nederlandse Organisatie voor Toegepast-Natuurwetenschappelijk Onderzoek TNO, Delft (NL)

( * ) Notice: Subject to any disclaimer, the term of this patent is extended or adjusted under 35 U.S.C. 154(b) by 1340 days.

(21) Appl. No.: 12/742,230

(22) PCT Filed: Nov. 7, 2008

(86) PCT No.: PCT/NL2008/050707

§ 371 (c)(1),
(2), (4) Date: Oct. 27, 2010

(87) PCT Pub. No.: WO2009/061195

PCT Pub. Date: May 14, 2009

(65) Prior Publication Data

US 2011/0050812 A1 Mar. 3, 2011

(30) Foreign Application Priority Data

Nov. 9, 2007 (EP) ..... 07120334

(51) Int. Cl.

| | |
|---|---|
| ***B41J 2/105*** | (2006.01) |
| ***B41J 2/09*** | (2006.01) |
| *B41J 2/03* | (2006.01) |

(52) U.S. Cl.

CPC ..... *B41J 2/09* (2013.01); *B41J 2002/031* (2013.01)

USPC ..... 347/82; 347/9; 347/75; 347/77

(58) Field of Classification Search

USPC ..... 347/9, 14, 75, 77, 82

See application file for complete search history.

(56) References Cited

U.S. PATENT DOCUMENTS

| | | | |
|---|---|---|---|
| 3,709,432 | A | 1/1973 | Robertson |
| 3,958,249 | A | 5/1976 | DeMaine et al. |

(Continued)

FOREIGN PATENT DOCUMENTS

| | | |
|---|---|---|
| CN | 1266783 | 9/2000 |
| CN | 101048283 | 10/2007 |

(Continued)

OTHER PUBLICATIONS

International Search Report issued in PCT/NL2008/050707 dated Feb. 4, 2009.

(Continued)

*Primary Examiner* — Daniel Petkovsek

(74) *Attorney, Agent, or Firm* — Knobbe, Martens, Olson & Bear, LLP

(57) ABSTRACT

A method and droplet selection device are provided for a continuous printer for selectively deflecting a droplet from a predetermined printing trajectory. In particular, a droplet selection device is provided for a continuous printer, comprising a droplet ejection system arranged to generate a continuous stream of droplets from a first fluid jetted out of an outlet channel; and a jet system arranged to generate a second jet for colliding the jet into the stream of droplets. The jet system comprises a deflector to selectively deflect the second jet into the continuous stream of droplets, so as to selectively deflect the droplets from a predefined printing trajectory.

21 Claims, 3 Drawing Sheets

(56) References Cited

U.S. PATENT DOCUMENTS

| | | | | |
|---|---|---|---|---|
| 4,190,844 | A | 2/1980 | Taylor | |
| 4,341,310 | A | 7/1982 | Sangiovanni et al. | |
| 4,914,522 | A | 4/1990 | Duffield et al. | |
| 5,180,065 | A * | 1/1993 | Touge et al. | 209/577 |
| 5,838,350 | A | 11/1998 | Newcombe et al. | |
| 5,907,338 | A | 5/1999 | Burr et al. | |
| 6,200,013 | B1 * | 3/2001 | Takeuchi et al. | 366/162.4 |
| 6,291,927 | B1 | 9/2001 | Percin et al. | |
| 6,299,288 | B1 | 10/2001 | Abeywardane et al. | |
| 6,357,866 | B1 | 3/2002 | van Rensburg | |
| 6,505,920 | B1 | 1/2003 | Braun | |
| 8,544,974 | B2 * | 10/2013 | Boot et al. | 347/9 |
| 8,826,848 | B2 * | 9/2014 | Houben et al. | 118/303 |
| 2007/0279467 | A1 | 12/2007 | Regan et al. | |
| 2007/0296773 | A1 | 12/2007 | Sharma et al. | |

FOREIGN PATENT DOCUMENTS

| | | | |
|---|---|---|---|
| EP | 0 011 170 | A | 5/1980 |
| EP | 0 422 616 | A | 4/1991 |
| EP | 0 943 436 | A | 9/1999 |
| EP | 1 219 431 | A | 7/2002 |
| EP | 1 228 874 | A | 8/2002 |
| EP | 1 398 155 | A | 3/2004 |
| EP | 1 637 329 | A | 3/2006 |
| GB | 1 521 874 | A | 8/1978 |
| GB | 2 041 831 | A | 9/1980 |
| GB | 1 598 779 | A | 9/1981 |
| JP | 50-51631 | A | 5/1975 |
| JP | 53134434 | A | 11/1978 |
| JP | 3101365 | A | 4/1991 |
| JP | 5185635 | A | 7/1993 |
| JP | 5-229126 | A | 9/1993 |
| JP | 07-314665 | A | 5/1995 |
| JP | 8258271 | A | 10/1996 |
| JP | 2005-254579 | | 9/2005 |
| WO | 2004/011154 | A2 | 2/2004 |
| WO | 2006/038979 | A1 | 4/2006 |
| WO | WO 2006/101386 | A | 9/2006 |

OTHER PUBLICATIONS

International Search Report issued in PCT/NL2008/050716 dated Jan. 5, 2009.

* cited by examiner

DROPLET SELECTION MECHANISM

This application is the U.S. National Phase of International Application No. PCT/NL2008/050707, filed Nov. 7, 2008, designating the U.S. and published in English as WO 2009/061195 on May 14, 2009 which claims the benefit of European Patent Application No. 07120334.3 filed Nov. 9, 2007.

FIELD OF THE INVENTION

The invention relates to a droplet selection device for a continuous printing system. In this connection, by a continuous jet printing technique is meant the continuous generation of drops which can be utilized selectively for the purpose of a predetermined printing process. The supply of drops takes place continuously, in contrast to the so-called drop-on-demand technique whereby drops are generated according to the predetermined printing process.

BACKGROUND OF THE INVENTION

A known apparatus is described, for instance, in U.S. Pat. No. 3,709,432. This document discloses a so-called continuous jet printer for printing materials using a first droplet ejection system arranged to generate a continuous stream of first droplets from a fluid jetted out of an outlet channel. During the exit of the fluid through an outlet channel, a pressure regulating mechanism provides, with a predetermined regularity, variations in the pressure of the viscous fluid adjacent the outflow opening. This leads to the occurrence of a disturbance in the fluid jet flowing out of the outflow opening. This disturbance leads to a constriction of the jet which in turn leads to a breaking up of the jet into drops. This yields a continuous flow of egressive drops with a uniform distribution of properties such as dimensions of the drops.

The publication shows a gas jet mechanism to selectively deflect the drops. The fluid jet length is controlled of droplets generated by the regulating mechanism. The deflection properties of the droplets differ from that of the jet, so that droplets can be selectively deflected.

SUMMARY OF THE INVENTION

In one aspect, the invention aims to provide an alternative to the continuous droplet ejection system that is used to deflect the continuous stream of the first droplets.

DETAILED DESCRIPTION OF THE EMBODIMENTS

According to an aspect of the invention, a droplet selection device for a continuous printer is provided, comprising: a droplet ejection system arranged to generate a continuous stream of droplets from a first fluid jetted out of an outlet channel; and a jet system arranged to generate a second jet for colliding the jet into the stream of droplets wherein the jet system comprises a deflector to selectively deflect the second jet into the continuous stream of droplets According to another aspect of the invention, a method of selecting droplets from a fluid jet ejected from a continuous printer is provided, comprising generating a continuous stream of droplets from a first fluid jet jetted out of an outlet channel, generating a second jet for colliding into the droplets so as to selectively deflect the droplets from a predefined printing trajectory wherein the second jet is selectively deflected and collided with a predefined first droplet.

It is noted that in this connection, the term jet is used to identify a continuous longitudinal shaped volume of material moving through space, to denote the contrast with (a series of) droplets, each formed of generally spherical isolated volumes.

Without limitation, droplet frequencies may be in the order of 2-80 kHz, with droplets smaller than 80 micron.

In addition, by virtue of high pressure, fluids may be printed having a particularly high viscosity such as, for instance, viscous fluids having a viscosity of more than $300 \cdot 10^{-3}$ Pa·s when being processed. In particular, the predetermined pressure may be a pressure up to 600 bars.

Figure 1:
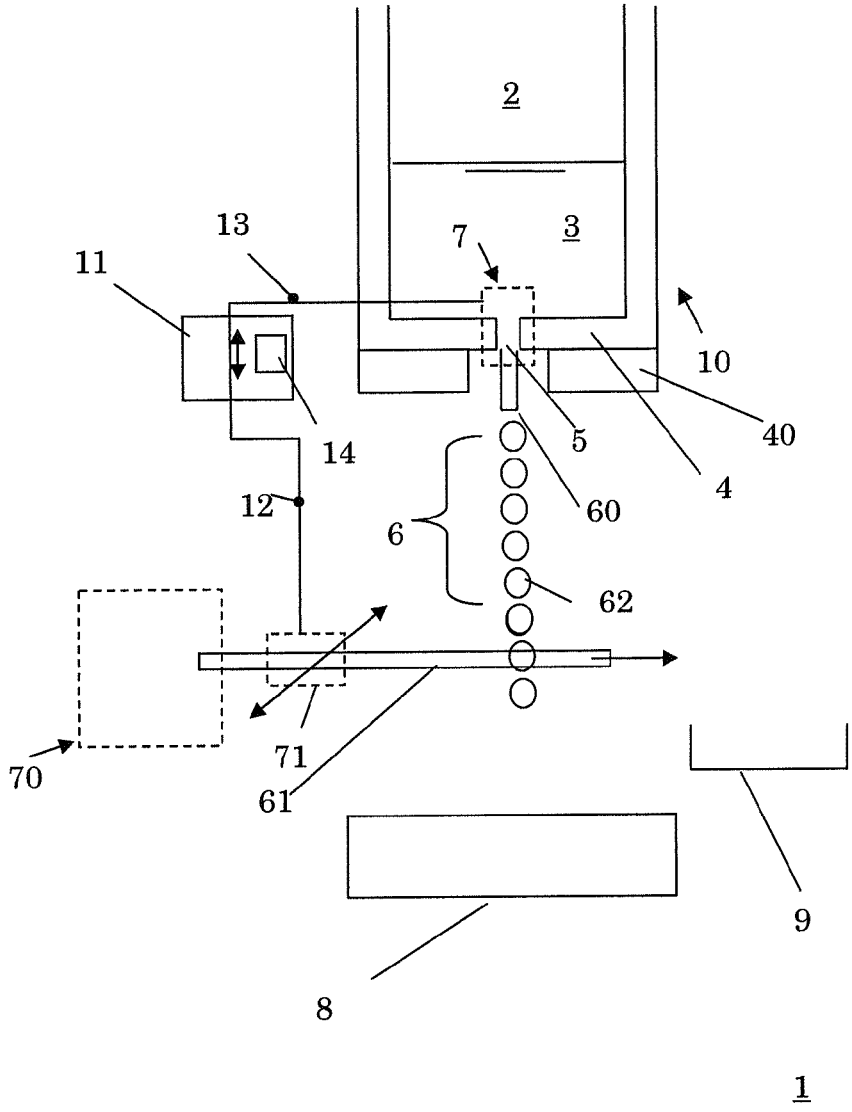
FIG. 1 shows schematically a first embodiment of a printing system for use in the present invention.
Figure 2:
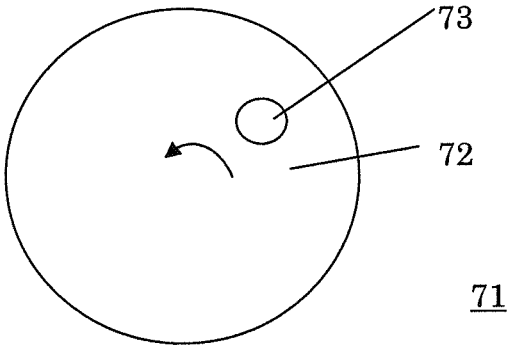
FIG. 2 shows a first embodiment of a deflecting jet system.
Figure 3:
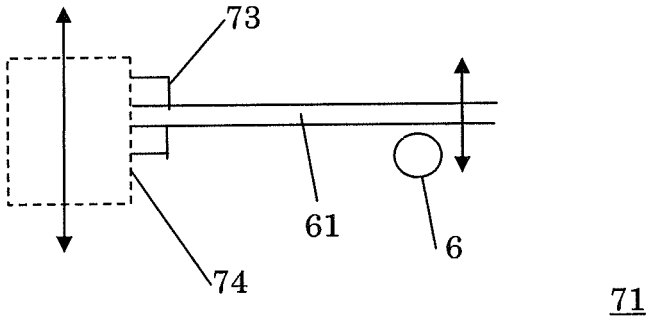
FIG. 3 shows a second embodiment of deflecting jet system.
Figure 4:
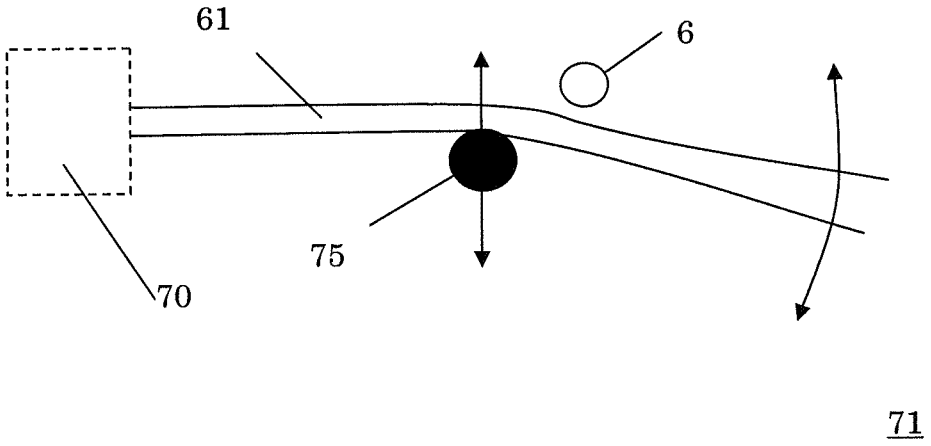
FIG. 4 shows a third embodiment of deflecting jet system.

Other features and advantages will be apparent from the description, in conjunction with the annexed drawings, wherein:

FIG. 1 shows schematically a first embodiment of a printing system for use in the present invention;

FIG. 2 shows a first embodiment of a deflecting jet system;

FIG. 3 shows a second embodiment of deflecting jet system;

FIG. 4 shows a third embodiment of deflecting jet system; and

Figure 5:
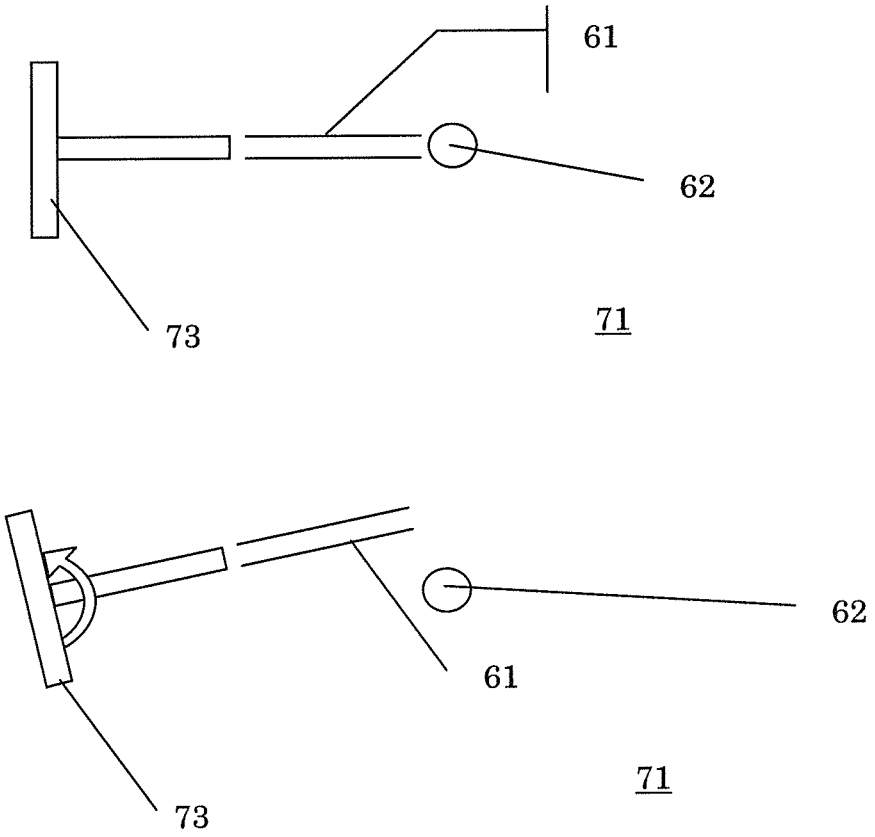
FIG. 5 shows an alternative embodiment of deflecting jet system.

FIG. 5 shows an alternative embodiment of deflecting jet system.

FIG. 1 shows a first schematic embodiment of a continuous printer head 1 according to the invention. The print head 1 comprises a first droplet ejection system 10 arranged to generate a continuous stream of first droplets 6 from a fluid jetted out of an outlet channel 5. The droplet ejection system 10 comprises a chamber 2, defined by walls 4. Chamber 2 is suited for containing a pressurized liquid 3, for instance pressurized via a pump or via a pressurized supply (not shown). The chamber 2 comprises an outlet channel 5 through which a pressurized fluid jet 60 is jetted out of the channel and breaks up in the form of droplets 6. Schematically shown, actuator 7 is formed near the outlet channel 5 and may be vibrating piezo-electric or magnetostrictive member. By actuation of the actuator 7, a pressure pulse is formed, breaking up the fluid jet and accordingly forming smaller monodisperse droplets 6.

The outflow opening 5 is included in a relatively thin nozzle plate 4 which can be a plate manufactured from metal foil, of a thickness of 0.3 mm for example 0.1-3 mm. The outflow opening 5 in the plate 4 has a diameter of 50 μm in this example. A transverse dimension of the outflow opening 5 can be in the interval of 2-500 μm. As an indication of the size of the pressure regulating range, it may serve as an example that at an average pressure up to 600 bars [$\equiv 600 \times 10^5$ Pa]. The print head 10 may be further provided with a supporting plate 40 which supports the nozzle plate 4, so that it does not collapse under the high pressure in the chamber. Examples of vibrating actuators may be found for example in WO2006/101386 and may comprise a vibrating plunger pin arranged near the outlet channel 5.

The distance interval of the vibrating plunger pin may depend on the viscosity of the fluid. When printing fluids having a high viscosity, the distance from the end to the outflow opening is preferably relatively small. For systems that work with pressures up to 5 Bars [≡$5\cdot10^5$ Pa], this distance is, for instance, in the order of 1.5 mm. For higher pressures, this distance is preferably considerably smaller. For particular applications where a viscous fluid having a particularly high viscosity of, for instance, $300\text{-}900\cdot10^{-3}$ Pa·s, is printed, an interval distance of 15-30 μm can be used. The vibrating pin preferably has a relatively small focusing surface area, for instance 1-5 mm2. In general, suitable ranges of the viscosity may be between $20\text{-}900\cdot10^{-3}$ Pa·s.

In FIG. 1 jet system 70 is arranged to generate a second jet 61. The second jet 61 is directed towards the stream of droplets 6 and is able to collide into a targeted droplet to selectively deflect the droplets from a predefined printing trajectory 3 towards a substrate 8. The jet is comprised of fluid, typically a gas-fase material. Jet system 70 is provided with deflection system 71, that deflects the second jet 61 from or into the continuous stream of droplets 6. The jet 61 accordingly moves in transverse direction relative to the predefined printing trajectory towards substrate 8. In FIG. 1, it is shown that the fluid jet 61 ejected from jet system 70 collides with a specific droplet 62. Accordingly droplet 62 of a stream of droplets 6 is not received on substrate 8 but for instance in a collection gutter 9. In a preferred embodiment printing material in collection gutter 9, comprised of a mixture of jet material 61 and droplets material 62, is demixed to recirculate printing liquid 3 through the printerhead 10 and/or to provide printing liquid to deflection system 70. Generally, the printhead 10 can be identified as a continuous print head. Control of the jet system 70, in particular deflector 71, is provided by a control circuit 11. The control circuit 11 comprises a signal output 12 to control actuation of the deflector 71 and signal input 13 indicative of a droplet generating frequency of the first droplet injection system 10. In addition, control circuit 11 comprises synchronizing circuitry 14 to synchronize a deflection movement of the deflector 71 to deflect jet 61 to an ejection frequency of first droplets 6 of the printhead 10. By control circuit 11, droplet 62 can be selectively deflected out of droplet stream 6 of the printhead 10 on individual basis. In one aspect of the invention a droplet frequency of the printhead 10 is higher than 20 kHz. In particular, with such frequencies, a droplet diameter can be below 100 micron, in particular below 50 micron. In addition to a jet speed of 8 m/s or higher, a deflection speed of the deflector 71 is well suited to select a predefined droplet 62 of continuous stream 6 to have it collided with a fluid jet 61 to selectively deflect the droplet 62 from a predefined printing trajectory. In view of selected viscosities of jet material 60, which may be ranging from $300\text{-}900\text{–}10^{-3}$ Pa·s, and the fact that they may be formed from an isolated printing material, that is printing material that is non-polar, generated droplets 6 are difficult to deflect by electromagnetic fields. The current inventive principle can provide a suitable alternative, which may be very specific to individual droplets 62. Accordingly a high dynamic range can be obtained by the deflection method according to the inventive embodiment depicted in FIG. 1. In one aspect the first droplets 6 are of a higher viscosity and/of isolating printing material. In that respect, the nature of the fluid jet 61 is typically a gas or a fluid having a very low viscosity. With the arrangement disclosed in FIG. 1 a method can be provided for selecting droplets 6 from a fluid jet 60 ejected from a continuous printer head 10. The droplets can be used for many purposes including image printing, rapid manufacturing, medical appliances and polymer electronics. In particular, the method is suited for printing fluids that fail to respond to electrostatic or electrodynamic deflection methods. Accordingly, for a continuous stream of first droplet 6 from a fluid jet 60, a deflection method is provided by generating a continuous stream 6 of droplets from a first fluid jet 60 jetted out of an outlet channel 5. A second jet 61 is generated for colliding into the droplets 6 so as to selectively deflect the droplet 6 from a predefined printing trajectory. The second jet 61 is selectively deflected and collided with a predefined first droplet 62. It is noted that the timescale of the trajectory change is very small so that it can be used for high frequency printing methods, in particular, more than 20 kHz. In addition the deflection method illustrated hereabove, in contrast to prior art methods is relatively insensitive for droplet size variations or droplet charge variations which do not significantly affect the deflection behavior.

FIG. 2 shows a specific embodiment of the deflector 71, depicted in FIG. 1. In particular, an air nozzle 73 is provided on a rotating disk 72. By rotating the air nozzle 73, the jet 61 can be deflected by synchronizing the rotation with the droplet frequency of stream 6, droplets 62 can be selectively deflected from the predefined printing trajectory towards substrate 8. Accordingly nozzle 73 is arranged to rotate the jet into and out of the predefined trajectory of droplets 6.

FIG. 3 shows an alternative embodiment of the deflector 71. Here the fluid jet 61 is translated sideways by a movement of a nozzle 73, for instance by a vibrating piezo-element attached to nozzle 73. Accordingly, a vibrating element 74 is coupled to a nozzle 73 to sideways translate the nozzle respective to the predefined trajectory, to produce a jet 61 that is sideways translated into and out of a droplet stream 6

FIG. 4 shows a further alternative embodiment of the deflector 71. Here a jet 61 produced by jet generator 70, is deflected by a curved surface 75, that is arranged to the brought in contact with jet 61. By "touching" the jet 61, Coanda's principle will provide a jet deflection, which can provide lateral displacement of the jet relative to the trajectory of droplets 6. Accordingly, the deflector 71 is provided by a curved surface 75 to be brought in contact with the fluid jet.

FIG. 5 shows an alternative embodiment of the deflector 71. In particular, an air nozzle 73 is provided that can rotate laterally with respect to an ejection direction of jet 61. By rotating the air nozzle 73, the jet 61 can be deflected by synchronizing the rotation with the droplet frequency of stream 6, droplets 62 can be selectively deflected from the predefined printing trajectory towards substrate 8. Accordingly nozzle 73 is arranged to rotate the jet into and out of the predefined trajectory of droplets 6. It is noted that minute rotations or tilts of the nozzle 73 may be sufficient to translate the beam over a relevant distance, depending on the distance of the droplets 62 relative to the nozzle 73. Accordingly, individual droplet selections may be possible of frequencies higher than 20 kHz In one aspect, deflection by impulse transfer can be used to selectively deflect the first droplets from a predefined printing trajectory towards a print substrate 8.

Alternatively, the jet deflection method can be used to chemically activate first droplets 62, for example, to selectively change the properties of the droplet 62 by fluid jet 61 in order to obtain a predetermined printing behavior. For example, this could be e.g. changing temperature, or changing the chemical properties by mixing.

In addition, by colliding droplets with fluid jet 61, special forms of encapsulated droplets can be provided. In this way, special droplet compositions can be provided, for example, a droplet having a hydrophile and a hydrophobe side, or a droplet having multiple colored sides, for example, a black and a white side or a droplet having red, green and blue sides.

The invention has been described on the basis of an exemplary embodiment, but is not in any way limited to this embodiment. Diverse variations also falling within the scope of the invention are possible. To be considered, for instance, are the provision of regulable heating element for heating the viscous printing liquid in the channel, for instance, in a temperature range of 15-1300° C. By regulating the temperature of the fluid, the fluid can acquire a particular viscosity for the purpose of processing (printing). This makes it possible to print viscous fluids such as different kinds of plastic and also metals (such as solder).

What is claimed is:

1. A droplet selection device for a continuous printer, comprising:

a droplet ejection system configured to generate a continuous stream of droplets from a first jet of a first fluid jetted out of an outlet channel; and a jet system configured to generate a second jet for colliding the second jet into the stream of droplets, the second jet being a continuous longitudinal jet of a second fluid, wherein the jet system comprises a deflector to selectively deflect the second jet into and out of a predefined trajectory of the continuous stream of droplets for colliding with a predefined first droplet of the continuous stream of droplets.

2. A droplet selection device according to claim 1, wherein the jet system comprises a control circuit to selectively deflect the second jet and to have it collided with the a predefined first droplet.

3. A droplet selection device according to claim 2, wherein the control circuit comprises signal inputs indicative of a droplet generating frequency of the droplet ejection system; and synchronizing circuitry to synchronize the deflector of the jet system to the frequency of the droplet ejection system.

4. A droplet selection device according to claim 1, wherein the deflector comprises a rotating nozzle, which is configured to rotate the second jet into and out of a predefined trajectory.

5. A droplet selection device according to claim 1, wherein the deflector comprises a vibrating element coupled to a nozzle to sideways translate the nozzle respective to a predefined trajectory.

6. A droplet selection device according to claim 1, wherein the deflector comprises a curved surface to be brought in contact with the second jet.

7. A droplet selection device according to claim 1, wherein the outlet channel is in the interval of 2-500 micron.

8. A droplet selection device according to claim 1, wherein the outlet channel length is in the interval of 0.1-3 millimeter.

9. A droplet selection device according to claim 1, wherein the outlet channel is in the interval of 5-250 micron.

10. A droplet selection device according to claim 1, wherein the outlet channel is in the interval of 5-100 micron.

11. A method of selecting droplets from a continuous stream of droplets ejected from a continuous printer, comprising:

generating the continuous stream of droplets from a first jet of a first fluid jetted out of an outlet channel;

generating a second jet for colliding the second jet into the droplets so as to selectively deflect the droplets from a predefined printing trajectory, the second jet being a continuous longitudinal jet of a second fluid; and selectively deflecting the second jet into and out of a predefined trajectory of the continuous stream of droplets to collide the second jet with a predefined first droplet of the continuous stream of droplets.

12. A method according to claim 11, wherein the droplets are formed from an isolating printing material.

13. A method according to claim 11, wherein the second jet is rotated into and out of the predefined trajectory.

14. A method according to claim 11, wherein the second jet is translated sideways respective to the predefined trajectory.

15. A method according to claim 11, further comprising contacting a curved surface with the second jet to selectively deflect the second jet.

16. A method according to claim 11 wherein the droplets are of a material having a viscosity higher than $300\text{-}900 \cdot 10^{-3}$ Pa·s.

17. A method according to claim 11, wherein the second jet is a gas jet.

18. A method according to claim 11, wherein collided droplets are received and demixed.

19. A method according to claim 11, wherein a droplet frequency of the continuous stream is higher than 2 kHz.

20. A method according to claim 11, wherein a droplet frequency of the continuous stream is in the range of 5-150 kHz.

21. A method according to claim 11, wherein a droplet frequency of the continuous stream is in the range of 10-70 kHz.

* * * * *

UNITED STATES PATENT AND TRADEMARK OFFICE

CERTIFICATE OF CORRECTION

PATENT NO. : 8,974,041 B2
APPLICATION NO. : 12/742230
DATED : March 10, 2015
INVENTOR(S) : Ronaldus Jacobus Johannes Boot et al.

It is certified that error appears in the above-identified patent and that said Letters Patent is hereby corrected as shown below:

IN THE SPECIFICATION

In column 2 at line 5, Change “droplets” to --droplets.--.

In column 3 at line 30, Change “printerhead” to --printhead--.

In column 3 at line 52, Change “$900\text{-}10^{-3}$” to --$900 \cdot 10^{-3}$--.

In column 3 at line 60, Change “and/of” to --and/or--.

In column 4 at line 32, Change “6” to --6.--.

In column 4 at line 54, Change “kHz” to --kHz.--.

IN THE CLAIMS

In column 5 at line 30 (approx.), In Claim 2, after “the” delete “a”.

Signed and Sealed this
Ninth Day of February, 2016

Michelle K. Lee

Michelle K. Lee
*Director of the United States Patent and Trademark Office*